US005248390A

United States Patent [19]

Fissmann et al.

[11] Patent Number: 5,248,390

[45] Date of Patent: Sep. 28, 1993

[54] WEB TIP CUTTING ARRANGEMENT FOR DRY END OF PAPER MAKING MACHINES

[75] Inventors: Hans-Joachim Fissmann; Johann Preisetanz, both of Heidenheim; Karl Steiner, Herbrechtingen, all of Fed. Rep. of Germany

[73] Assignee: J. M. Voith GmbH, Fed. Rep. of Germany

[21] Appl. No.: 775,140

[22] Filed: Oct. 11, 1991

[30] Foreign Application Priority Data

Nov. 30, 1990 [DE] Fed. Rep. of Germany ..... 4038250

[51] Int. Cl.[5] ..... D21F 1/36

[52] U.S. Cl. ..... 162/193; 162/194; 162/286; 34/117; 34/120

[58] Field of Search ..... 162/359.1, 193, 255, 162/200, 286, 273, 194; 34/116, 34, 117, 118, 120

[56] References Cited

U.S. PATENT DOCUMENTS

| | | | |
|---|---|---|---|
| 4,809,445 | 3/1989 | Meyer et al. | 34/117 |
| 4,918,836 | 4/1990 | Wedel | 162/194 |
| 4,945,655 | 8/1990 | Wedel | 162/194 |
| 4,972,608 | 11/1990 | Ilvespä/ | 34/117 |
| 4,980,979 | 1/1991 | Wedel | 34/117 |
| 5,033,207 | 7/1991 | Sturm et al. | 34/117 |

*Primary Examiner*—Peter Chin
*Assistant Examiner*—Dean Tan Nguyen
*Attorney, Agent, or Firm*—Ostrolenk, Faber, Gerb & Soffen

[57] ABSTRACT

The dry end of a paper making machine includes a first dryer group of heatable web dryer cylinders followed by a second dryer group of heatable dryer cylinders. Each dryer cylinder has a neighboring suction guide roll. Respective first and second web support belts are provided for the first and second dryer groups. The paper web to be dried alternately passes between a dryer cylinder and the neighboring suction guide roll, such that the web comes into direct contact with the dryer cylinders. A transfer region is located between the two dryer groups at which the web is transferred from the first to the second web support belt. A displaceable guide roll in the transfer region is associated with at least one of the first and the second web support belts. The guide roll is displaceable between a position at which the support belt supports the web and another position at which the displaceable support belt is moved away from the web at one of the dryer groups, creating a free length of web between the one dryer group and a deflection roll between the dryer groups. The displaceable guide roll may be the deflection roll between the dryer groups or may be another roll past which passes the same support belt that is passing over the deflection roll. A web tip cutter is associated with the free length of the web to there produce a starting end of the web for purposes of threading.

12 Claims, 4 Drawing Sheets

WEB TIP CUTTING ARRANGEMENT FOR DRY END OF PAPER MAKING MACHINES

BACKGROUND OF THE INVENTION

The present invention relates to a dry end for a paper making machine and particularly to cutting the web for threading its leading end into a dryer group. Dry ends which are formed of so called single wire dryer groups are known from:

1. "Wochenblatt fur Papierfabrikation," No. 22, 1988, pg. 6;
2. International Application WO 90/01580;
3. International Application WO 90/02225;
4. German Utility Model G 90 01 209.

These publications disclose that dryer cylinders can be arranged, at least in the predominant part of the dry end, in either at least approximately horizontal or at least approximately vertical rows. Such a dry end is divided into several dryer groups. Each dryer group comprises a plurality of heatable dryer cylinders, a plurality of deflecting rolls, with one deflecting roll between each neighboring pair of dryer cylinders, and a support belt which presses the web to be dried against the dryer cylinders.

Publication 4 above shows successive dryer groups of a dry end, wherein one side of the web initially comes into contact with the outer surfaces of the dryer cylinders in the first group and the other side of the web comes into contact with the outer surfaces in the dryer cylinders of the second group. In contrast, in the dry end, in application 3, the same side of the web comes into contact with the outer surfaces of the individual cylinders of both or of all dryer groups. Both designs were considered for the purpose of the present invention.

Applications 2 and 3 disclose a web tip cutter which is installed at the outlet end of the dry end. As long as the web travels in the broke pulper, a narrow edge strip can be cut from the web by the web cutter. That edge strip then serves for threading the web into the following treatment stations, for instance, a calendar and reeler, a glue press, or the like. For such a tip cutter, a free length of web is formed by means of a special arrangement of rolls because upon the cutting of the tip, the web must be free of the support belt which otherwise travels along together with the web.

In Application 2, a free length of the web is formed at the place of separation between the next to the last and the last dryer groups and therefore at a place where the web is still not completely dry. As a result, there is the danger that the web may tear upon the cutting of its tip. On the other hand, if necessary, use may be made of the possibility of controlling the tension of the web upon its being cut by the tip, by changing the differential of the speeds between the two dryer groups.

In Application 3, a free length of the web is formed within the last dryer group, preferably between the last two dryer cylinders, and therefore at a place where the web is completely dry. Thus, the web should only rarely tear upon its being cut by the tip. There is a deflecting roll with which the support belt comes into direct contact and between the last two dryer cylinders. In addition, a web guide roll is arranged below this deflecting roll. The web travels free of the support belt, from the deflecting roll to the web guide roll and from the latter back to the deflecting roll so that two free lengths of web are present. The tip cutter is arranged on one of these two free lengths of web. This arrangement has the danger that upon tearing of the web or upon some other unstable operating condition, the web may wind up on the web guide roll. Furthermore, it has the disadvantage that there are two free lengths of web although only a single free length of web is required for the tip cutter. The danger of tearing, which is always present on every free length of web, is therefore unnecessarily increased.

Application 3 discloses a dry end in which a transfer or separation between two successive dryer groups is neither shown nor plays a part. It concerns forming open lengths of the paper web at which a cutter can be inserted. In this case, two successive dryer cylinders are wrapped by the paper web and by the felt support belt web jointly such that the paper web is contained in sandwich like fashion between the outer surface of the corresponding dryer cylinder and the support felt which travels on its outer side. Between the two dryer cylinders, two guide rolls are arranged. The guide roll that is closer to the dryer cylinder is wrapped around solely by the felt support belt, while the other guide roll which is further from the dryer cylinders is wrapped around solely by the paper web. Thus, free lengths of the paper web are formed between the two guide rolls. The tip cutter can act on these free lengths. The free lengths are thus continuously present, with all the risks which are inherent in high machine speeds, particularly the risk of fluttering and tearing.

German Patent Application P 40 12 246, which does not constitute a prior art publication, discloses a dry end which is comprised of single line dryer groups. Two guide rolls are again provided within a dryer group between two neighboring dryer cylinders. Between these two guide rolls there is a central guide roll. The central guide roll is wrapped around solely by the support belt so that a free length of the paper web is produced between the lower and the upper guide rolls (see FIG. 3 thereof). A tip cutter can be placed on this free length of the paper web.

This embodiment is advantageous, as compared with that shown in Application 3 above, since only a single free paper web length is present instead of two. However, this free length of paper web is also present continuously, and therefore also during the operation of the paper making machine at high speed.

SUMMARY OF THE INVENTION

The object of the present invention is to enable cutting of the leading end of the web to prepare it for threading into a dryer group.

Another object is to support the web over its path into the dryer group into which it is to be threaded during regular machine operation.

A further object is to make the web available for being cut from the support belt at desired cutting times.

Yet another object is to minimize the number of free unsupported web lengths, especially at the time of web cutting.

The present invention concerns a dry end of a paper making machine having a first dryer group of first dryer cylinders and a second dryer group of second dryer cylinders, which follows the first dryer group, and having a web transfer zone between the first and the second dryer groups, at which the web is transferred from the first to the second dryer group. In connection with the process for threading the web into the second dryer group or beyond, at least one roll associated with at least one of the dryer groups and located at least generally at the transfer zone is shiftable so as to temporarily produce a free length portion of the moving web, at which the web is not supported by a support belt which normally supports it. The at least one roll is also shiftable back to restore the support of the web by the support belt.

The invention has as it primary object that the risks resulting from the presence of a free length of the web are avoided, particularly the danger of the web tearing and the danger of the web wrapping around a roll, but in such a manner that at the same time a tip cutter can be rapidly and easily inserted to cut the web when necessary.

Proceeding from a dry end as shown in accordance with Published Utility Model 4, this object is achieved by having a moveable guide roll associated with at least one of the first and second support belts for shifting that support belt between two primary positions. In one position of the guide roll, that support belt is moved by the roll to be in the path of the web between the dryer groups so that the web is supported in its path between the two dryer groups. In its other position the guide roll and the support belt passing over the roll have been shifted away from the web, so that the web has a free unsupported length over part of its travel between the dryer groups.

Between the dryer groups, there is a web transfer zone at which the web is transferred from the support belt of one dryer group to the support belt of the next dryer group. In that transfer zone, there is a deflection roll around which at least one support belt from at least one of the dryer groups and the support web pass. The displaceable guide roll may be the same roll as the deflection roll or there may be a separate displaceable guide roll which is spaced away from the deflection roll. In either arrangement, the movement of the deflection roll creates the free length of the web.

The invention concerns placing a tip cutter in the transfer zone in the region of the free length of the web, so that when the free length of the web is formed by displacement of the guide roll, the tip cutter is in position to cut the web to form the leading end of the web for threading into the second dryer group.

Other objects and features of the invention are described with reference to the accompanying drawings.

DESCRIPTION OF THE PREFERRED EMBODIMENTS

Figure 1:
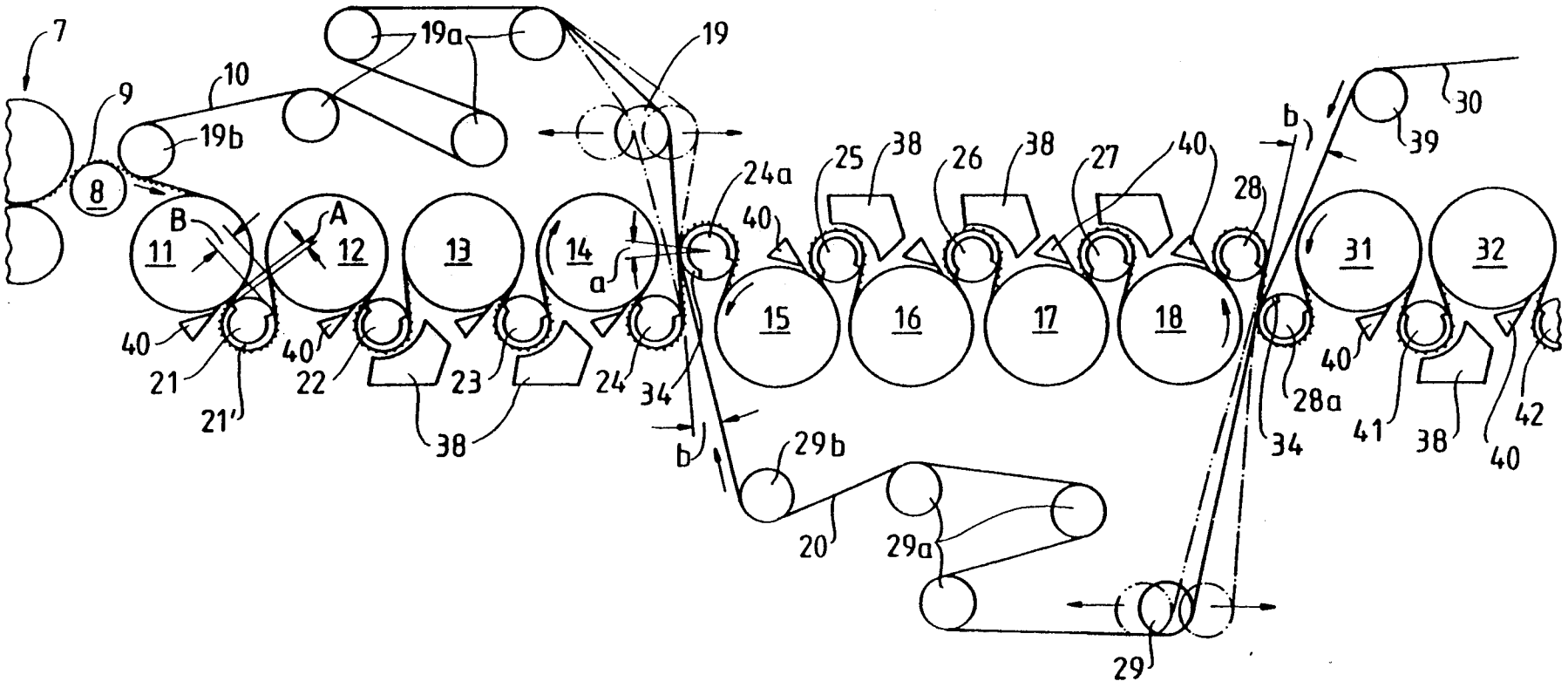
FIG. 1 schematically shows a dry end of a paper making machine having a plurality of dryer groups arranged one after the other, wherein the side of the paper web being dried on dryer cylinders is reversed upon passage of the web from one dryer group to the next one.

The dry end of a paper making machine is shown in FIG. 1. The paper web 9 to be dried, shown in part in a dotted line, travels from left to right in the drawing, through the dry end. The web passes over a first dryer group which is comprised of four heatable dryer cylinders 11 to 14 which are arranged in a top row and four belt guide rolls 21–24 which are arranged in a bottom row below the dryer cylinders. The guide rolls are suction guide rolls.

A paper guide roll 8 transfers the paper web 9 from the outlet end of a press end 7 of the machine onto a first endless support belt 10 which is preferably developed as a dryer wire screen or wire. The support belt travels first over a guide roll **19*b* which, if necessary, can be developed as a suction roll. The paper web 9 travels together with the support belt 10 in a meander path through the dryer group, i.e. alternately over one of the dryer cylinders 11 to 14 and then over the adjacent following one of the suction guide rolls 21 to 24. Following the last suction guide roll 24, the endless support belt 10 travels over several normal belt guide rolls 19 and 19*a* back to the first belt guide roll 19*b*. At the discharge side of each dryer cylinder 14, there is a very short distance A, between 30 and 100 mm, between the periphery of the cylinder and the periphery of the adjacent suction guide roll. This assures that the web does not remain stuck on the surface of the cylinder but rather follows directly along with the support belt 10. The suction zone 21'** of the suction guide roll also assures this. Each of the suction guide rolls can be equipped with a conventional stationary inner suction box or with an external suction box in accordance with U.S. Pat. No. 4,202,113. Web stabilizers, such as that described in French published specification 2,628,518, are no longer required.

The second dryer group follows the first dryer group and is comprised of a bottom row of four dryer cylinders 15 to 18 and an upper row of five upper suction guide rolls **24*a* and then 25 to 28, and each of rolls 25 to 28 follows a respective dryer cylinder. Through this second dryer group there travels a second paper web support belt 20, which then travels from the last suction guide roll 28 of the second dryer group over several normal belt guide rolls 29, 29*a* and 29*b* back to the first suction guide roll 24*a* of the second group. The suction guide roll 24*a* is developed as a take off roll which transfers the paper web directly from the first support belt 10 to the second support belt 20 without a free length of paper being produced thereby. In the same way, the paper web is transferred at the end of the second dryer group, following the last suction guide roll 28 of the second dryer group as seen in direction of travel, by a further take off roll 28*a* into the next dryer group. Here also a free length of the paper web is avoided. Of this third dryer group, only two dryer cylinders 31 and 32, part of a support belt 30, suction guide rolls 41 and 42, and a belt guide roll 39** are visible.

In the first dryer group a first side, in the example shown, the bottom side, of the paper web 9 is moved into direct contact with the dryer cylinders 11 to 14. In the second dryer group, on the other hand, a second side, shown as the top side, of the web 9 is moved into direct contact with the dryer cylinders 15 to 18. In the third dryer group, it is the bottom side of the web which again is moved into direct contact with the dryer cylinders 31, 32.

The belt guide roll 19, which follows the last suction guide roll 24 of the first dryer group as seen in the direction of travel, is displaceable back and forth in an approximately horizontal direction. The roll 19 is shown in three different positions. In its solid line normal position, the first support belt 10 travels from the roll 24 to the roll 19 over a straight path which forms a tangent to the periphery of the take-off roll 24. Thus, the second support belt 20 comes into contact with the first support belt 10 here only at a "point." Another possible position of the belt guide roll 19 is shown in dash-dot lines. In this position, the second support belt 20 comes into contact with the first support belt 10 in the region of a small part of the periphery of the take-off suction roll 24. This small peripheral part corresponds to an angle of wrap a of about 10°. This angle of wrap a can, however, be varied between 0° and about 20°, namely by the operator of the machine displacing the belt guide roll 19 to adjust any angle of wrap in accordance with the requirements at the time. Thus, the machine operator can make the angle of wrap a dependent, for instance, on the type of paper and/or the speed of rotation and/or the amount of the differential speed which must be set at times between the two belts 10 and 20. This enables the transfer of the paper web 9 from the first dryer group to the second dryer group to be effected with a high degree of certainly, i.e. without danger of tears, even at maximum work speeds. Furthermore, the threading of the so called transfer strip (i.e. a narrow edge strip of the web of paper) can be effected automatically without a so called rope guide being necessary.

Regardless of how large the angle of wrap a is set, a wedge shaped slot is always present between the two support belts 10 and 20, in the direction toward the take-off roll 24*a*, as seen in the direction of travel. That slot has the angle of convergence b. The size of this angle of convergence b can be freely selected in accordance with the existing conditions as to space, and can for instance, be between 2° and 30°.

On its path from the belt guide roll 29*b* to the take-off roll 24*a*, if the second support belt 20 carries along with it air boundary layers which disturb the transfer of the web, it is advisable to provide a lengthened suction zone 34 or an additional pre-suction zone in the take-off roll 24*a*. This zone can be noted in FIG. 1 where the second support belt 20 travels onto the take-up roll 24*a*.

Occasionally, one of the dryer groups must be shut down while the others continue to operate. It is advisable to temporarily establish a distance between the two belts 10 and 20 at the take-off roll 24*a*. For this purpose, the belt guide roll 19 can be pushed into another separating position which is shown in FIG. 1 by a dash and two dots line.

As is customary, a scraper 40 is provided on the free part of the surface of each dryer cylinder at a point around the cylinder just after the web leaves the cylinder. Further, air blast boxes 38 are provided on at least some of the suction guide rolls 22 to 27 and 41. Each air blast box includes a suction chamber (not shown) which serves for leading away moist air. Each air blast box surrounds the adjacent suction guide roll over approximately a quarter of its circumference, particularly in the second half of the zone wrapped by the support belt 10, 20 or 30. This requires a special provision in the first two dryer groups. Each of the suction guide rolls 21 to 27 is arranged asymmetrically with respect to the two adjacent dryer cylinders. For instance, guide roll 21, and the two adjacent dryer cylinders 11 and 12 can be referred to as a "roll set" with a "web delivering cylinder" and a "web receiving cylinder" 12. As mentioned above, a very small distance A is provided between the web delivering cylinder and the suction guide roll. On the other hand, the distance B between the suction guide roll and the web receiving cylinder is substantially greater, namely about 2 to 10 times greater than the distance A. This asymmetric arrangement of the suction guide roll has several advantages. Space is gained for arranging a relatively large air blast box 38 alongside the scraper 40 so that sufficient distance for conducting the air still remains between them, as well as a distance which is also necessary between the air blast box and the web receiving cylinder. Furthermore, a zone is also created between the suction guide roll and the web receiving cylinder in which water vapor can emerge from the paper web. This is true of all suction guide rolls, regardless of whether an air blast box is present.

After the paper web 9 has reached a certain solids content, for instance at the end of the second dryer group, there may be less tendency of the web to stick to the dryer cylinder surfaces than previously. It may therefore be possible, for instance, commencing in the third dryer group, to make the distance between the web delivering side of each cylinder and the following suction guide roll even greater than previously. It is also possible to arrange the suction guide rolls there symmetrically with respect to the adjacent dryer cylinders, as shown at 31, 32 and 41.

In the dry end shown in FIG. 1, all of the dryer cylinders lie in respective horizontal rows of cylinders of each of the dryer groups. However, the invention can also be employed in dry ends with vertical rows of cylinders, for instance similar to the arrangement shown in German Utility Model G 89 06 273.

The primary feature of the invention is the displaceability of the guide roll 19 or of the guide roll 29. In this way, separation between the two dryer groups defining a web transfer zone and thus a free length of web can be produced. In the region of the free length of web, a tip cutter can be arranged in accordance with the invention, but this is not shown in FIG. 1.

Figure 2:
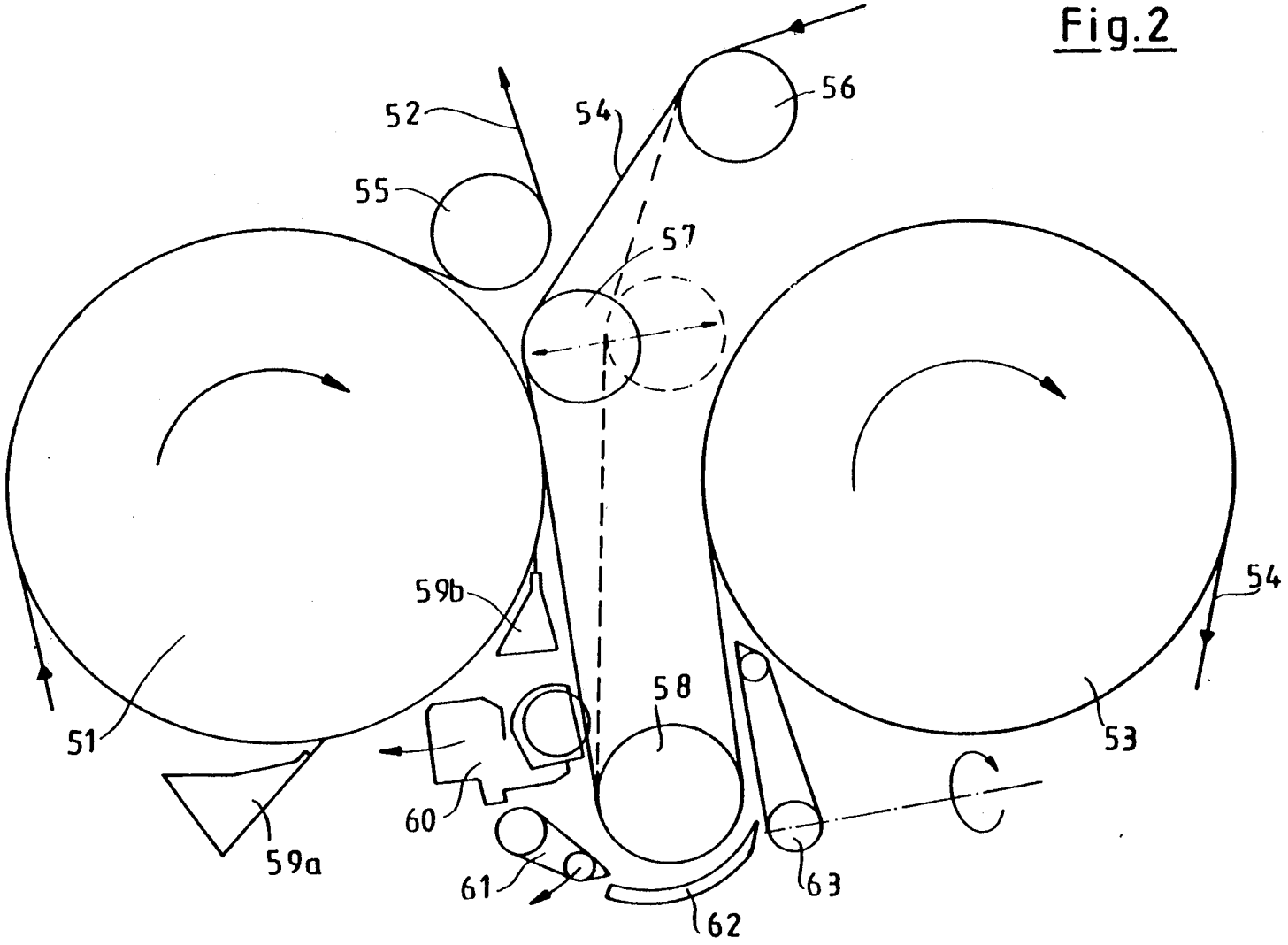
FIG. 2 shows a transfer zone between two successive dryer groups wherein there is no reversal of the side of the paper web being dried on dryer cylinders.

FIG. 2 details certain features of the ends of adjacent dryer groups and the web transfer zone between them. The last dryer cylinder 51 of a first dryer group is wrapped by a felt web support belt 52. Furthermore, the dryer felt 52 leaves the cylinder 51 and wraps a felt guide roll 55. The first dryer cylinder 53 of a following second dryer group is wrapped by a dryer wire web support belt 54. Prior to contacting the dryer cylinder 53 as seen in the direction of travel, the dryer wire 54 partially wraps the guide rolls 56, 57 and 58. Guide roll 57 is displaceable in the directions indicated by the arrows. When the roll 57 is displaced into the position shown by the dashed line, the dryer wire 54 assumes the course also shown by the dashed line.

There are two scrapers 59*a* and 59*b* at the dryer cylinder 51 circumferentially after the felt 52 separates from the web and after the guide roll 57. There is a web tip cutter 60 which is swingable in the path and direction indicated by the arrow to cut the tip of a web as required. The parts 61, 62 and 63 are conventional web transfer aids which can optionally be used. However, they are generally not necessary, particularly if the roll 58 is a suction roll. The latter design is preferred.

The course of the web of paper in FIG. 2 is understandable to the person skilled in the art. The web of paper is first enclosed between the dryer felt 52 and the outer surface of the dryer cylinder 51. After the dryer felt 52 has traveled off the surface of the dryer cylinder 51 and wrapped around the guide roll 55, the web then follows the dryer cylinder 51 without an outer covering outside the web. The paper web is briefly again enclosed for a very short distance, between the surface of the dryer cylinder 51 and the dryer wire 54, as soon as the wire 54 leaves the displaceable guide roll 57. The dryer wire 54 supports the paper web, moves it downward, leads it around the guide roll 58 and leads the web to rise upward together with the dryer wire 54 on which the paper web is lying to and around the dryer cylinder 53. Along this path and before, during and after the wrapping of the guide roll 58, the paper web is located on the outside of the dryer wire. The dryer wire 54 and the paper web then enter into the region of the surface of the dryer cylinder 53 where the paper web again lies between the surface of the dryer cylinder 53 and the dryer wire 54.

If the dryer wire guide roll 57 is swung into the dashed line position and if the dryer wire 54 accordingly assumes the dashed line position, then a free unsupported length of the paper web is produced between the dryer cylinder 51 and the guide roll 58. This makes it possible to then swing the tip cutter 60 into its operating position.

It may be advisable to provide a web stabilizer, not shown, which is displaceable together with the displaceable guide roll 57. Such a web stabilizer serves for applying the web in each case to the course of the dryer felt which travels off from the corresponding dryer cylinder or from the suction rolls.

Figure 3:
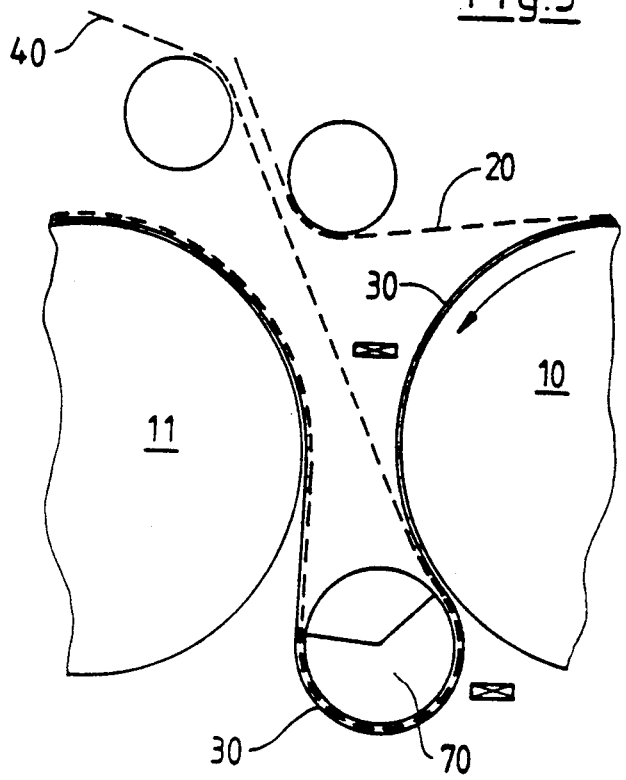
FIGS. 3 to 8 show transfer zone embodiments, wherein the side of the paper web being dried on the dryer cylinders is reversed between the two successive dryer groups.
Figure 4:
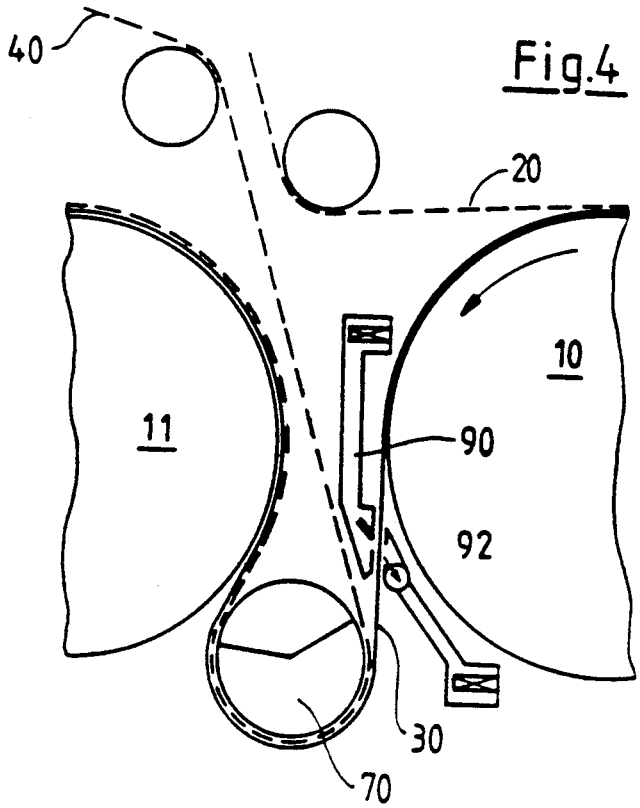

FIGS. 3 and 4 show the same object, namely the last dryer cylinder 10 of a first dryer group, the first dryer cylinder 11 of a second dryer group and the transfer zone between them. There is a dryer wire 20, which wraps around the last dryer cylinder 10 of the first dryer group, and a dryer wire 40, which wraps the first dryer cylinder 11 of the second group. The two dryer wires are shown in respective dashed lines. A web of paper 30 is shown in solid line. A guide roll 70 can be swung from the position shown in FIG. 3 into the position shown in FIG. 4. If the guide roll 70 is swung into the position shown in FIG. 3, then the web transfer place is closed. The web of paper does not have a free unsupported length anywhere. Viewed from the right to the left in FIG. 3, the web has the following course. Initially, the web is enclosed between the surface of the dryer cylinder 10 and the dryer wire 20. After moving off the dryer wire 20, the web 30 follows the surface of the dryer cylinder 10 and the web is not there enclosed. The web is next enclosed for a short distance over the dryer cylinder by the dryer wire 40, which approaches from above. Together with the dryer wire 40, the web arrives at the displaceable guide roll 70. There the dryer wire 40 with the web of paper 30 present on it, wraps around the guide roll 70, and the paper web 30 is lying on the outside of the wire. Both the paper web 30 and the dryer wire 40 finally arrive together at the dryer cylinder 11, and the web 30, covered by the dryer wire 40, wraps around the dryer cylinder 11.

After the guide roll 70 is swung into the position shown in FIG. 4, a free path is produced over which the web of paper 30 travels free of a support wire, between the point of run off from the surface of the dryer cylinder 10 up to the point of arrival on the guide roll 70. At this place, a web tip cutter can again be inserted.

For considerations of space, it is advisable to use a high pressure water jet cutting device 90. The cutting nozzle and its corresponding holder are movable on rails transversely to the direction of travel of the web. Upon a tear in the web, the web of paper is again threaded. For this purpose, the water jet cutting device travels from a parked position, along the rails and up to the required width of strip transverse to the web of paper. By automatic opening of the water valve, the continuous cutting process is commenced. On the opposite side of the web, the water jet, as well as substances which have been flushed out, are collected at 92 and then are led away transverse to the paper machine.

As soon as the cut strip of paper has been threaded by means of guide plates and blast means, the transverse, that is, across the width of the web, travel of the water jet cutting device takes place until the strip has been widened from its originally slight width to the entire width of the web. Thereafter, the water jet cutting device is moved back into its parking position. At the same time, the displaceable guide roll 70 is moved back into its dryer operating position shown in FIG. 3 so that the web is again conducted without an open length section. In this case, also, the guide roll 70 is preferably developed as a suction roll.

Figure 5:
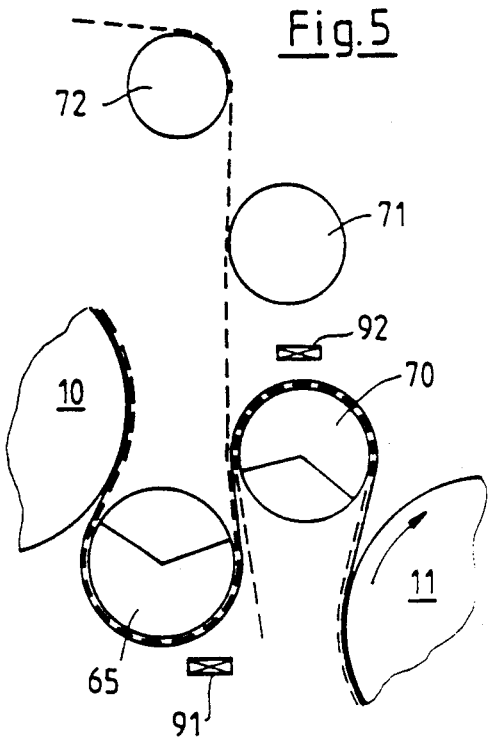
Figure 6:
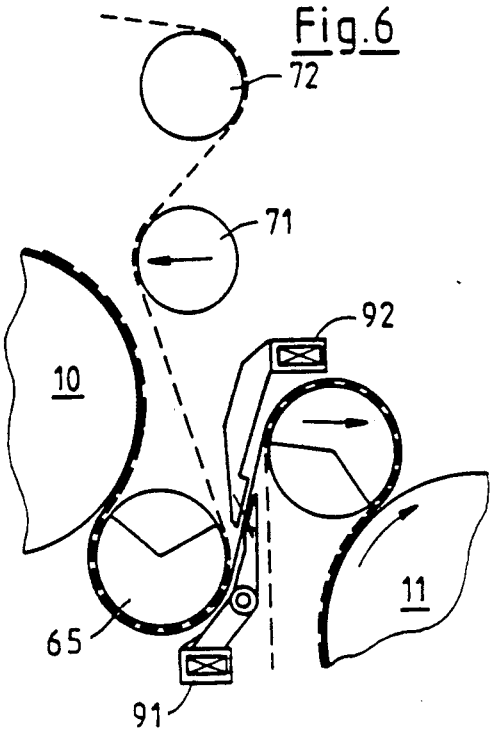

The embodiment in FIGS. 5 and 6 again shows two dryer cylinders 10 and 11. The web here travels from left to right and thus from the dryer cylinder 10 over guide rolls 65 and 70 onto dryer cylinder 11. Wire belt guide rolls 71 and 72 can be noted. In this arrangement, the guide rolls 71 and 72 are swingable in horizontally opposite directions, from the position shown in FIG. 5 in which the transfer of the web of paper between dryer cylinders 10 and 11 is a closed supported transfer, into the position shown in FIG. 6 in which a free length of web is formed between guide rolls 65 and 70. A high pressure water jet cutting device is again provided. In FIG. 5, only the guide rails 91 and 92 extending transverse to the machine direction are shown. FIG. 6 shows the cutting device with its associated water collection device.

Figure 7:
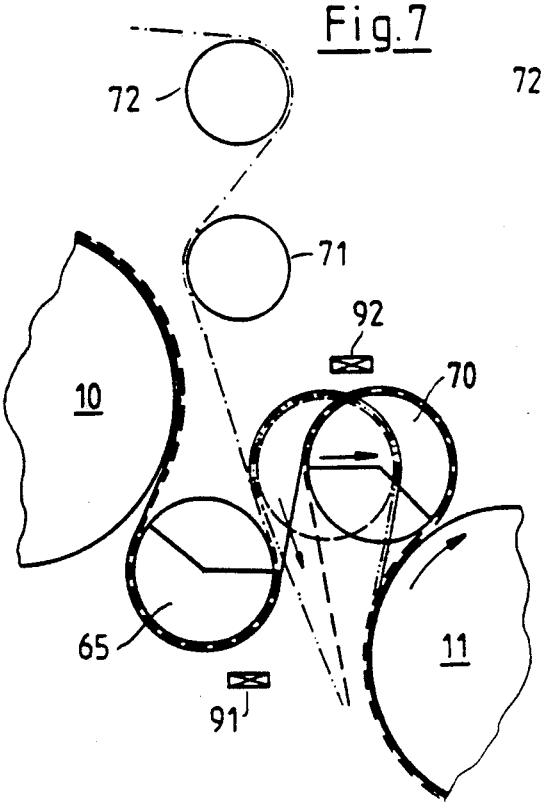
Figure 8:
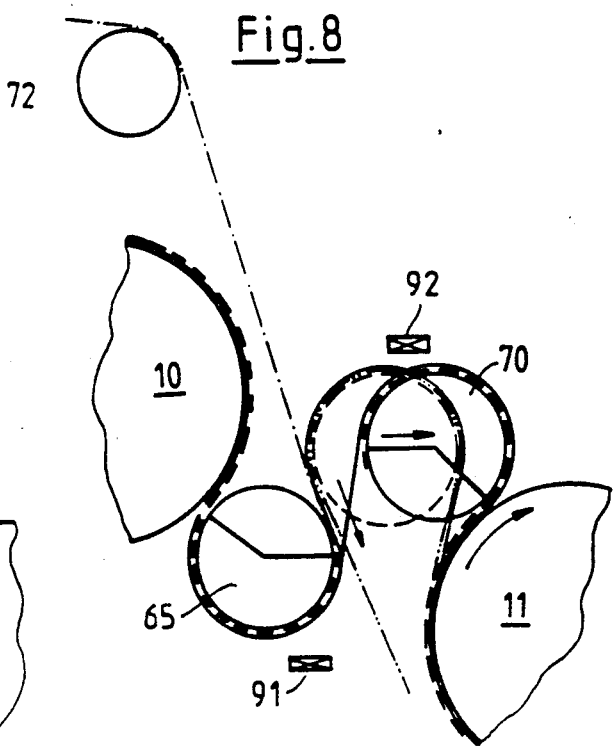

FIGS. 7 and 8 show two other embodiments of web transfer devices. They differ from the embodiment of FIGS. 5 and 6 essentially by the fact that for the temporary formation of a free length of the paper web, only one guide roll, namely the wire guide roll 70, is horizontally displaceable while all other guide rolls, and especially roll 65, are fixed in position.

It is preferable also in the embodiments shown in FIGS. 7 and 8 for the two guide rolls 65 and 70, between which the free length of paper web is formed, to be suction rolls.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dry end of a paper making machine comprising:

a plurality of first heatable web dryer cylinders in the path of a web to be dried and forming a first dryer group; a respective first suction guide roll in sequence in the web path with each first dryer cylinder;

a plurality of second heatable dryer cylinders also in the path of the web to be dried and forming a second dryer group, a respective second suction guide roll in sequence in the web path with each second dryer cylinder; the second dryer group following the first dryer group;

a first web support belt in the first dryer group and passing with the web on it alternately over one of the first dryer cylinders and over the neighboring first suction roll in the first dryer group; the web being on the side of the first support belt so that the web comes into direct contact with the first dryer cylinders while the first support belt comes into direct contact with the first suction guide rolls;

a second web support belt in the second dryer group and passing with the web on it alternately over one of the second dryer cylinders and over the neighboring second suction roll in the second dryer group; the web being on the side of the second support belt so that the web comes into direct contact with the second dryer cylinders while the second support belt comes into direct contact with the second suction guide rolls;

a transfer region between the first and the second dryer groups at which the web is transferred from the first support belt to the second support belt;

one guide roll generally at the transfer region in normal engagement with at least one of the first and second support belts, the one guide roll being displaceable between a web support position, at which the one guide roll is positioned to guide the at least one support belt at the one guide roll to where the at least one support belt supports the web in its travel through the transfer region, so that the web is transferred continuously, without any unsupported length, from the first support belt to the second support belt, and a web free length position away from the web support position, at which the one guide roll guides the at least one support belt to not support the web over part of the path of the web through the transfer region, defining a free length of the web in the transfer region;

a web tip cutter positioned to cut the free length of the web in the web transfer region when the one guide roll is in its web free length position, for producing a starting end of the web to be threaded.

2. The dry end of claim 1, wherein the first dryer group includes a last one of the first dryer cylinders and the second dryer group includes a first one of the second dryer cylinders in the path of the web through the dry end, the transfer region being between the last of the first dryer cylinders and the first of the second dryer cylinders.

3. The dry end of claim 2, wherein there is at least one web support belt deflection roll between the last of the first dryer cylinders and the first of the second dryer cylinders; at least one of the first and second support belts, with the web supported on it, passing around the one deflection roll, the moveable guide roll being placed such that the free length of web is formed between the deflection roll and one of the first and the second dryer groups.

4. The dry end of claim 3, wherein the deflection roll and the guide roll are the same roll.

5. The dry end of claim 3, wherein the displaceable guide roll is separate from the deflection roll and the displaceable guide roll is displaceable with respect to the deflection roll.

6. The dry end of claim 3, wherein the deflection roll is a suction roll.

7. The dry end of claim 3, wherein the moveable guide roll engages one of the first and second support belts.

8. The dry end of claim 3, wherein the first and the second support belts so pass over the respective first and second dryer cylinders and the web is so supported on the first and the second support belts and the transfer region are all such that one side of the web is moved into contact with each of the first dryer cylinders and the other side of the web is moved into contact with the second dryer cylinders.

9. The dry end of claim 1, wherein the first and the second support belts pass over the respective first and second dryer cylinders and the web is supported on the first and the second support belts in the transfer region such that one side of the web is moved into contact with each of the first dryer cylinders and the other side of the web is moved into contact with the second dryer cylinders.

10. The dry end of claim 1, further comprising a web stabilizer near the displaceable guide roll and associated with the free length of the web for stabilizing the travel of the web.

11. A dry end of a paper making machine comprising:

a first dryer group comprising at least one first dryer cylinder; a second dryer group comprising at least one second dryer cylinder; the second dryer group following the first dryer group in the path of a web through the dry end;

a first web support belt passing with the web on it over the first dryer group; a second web support belt passing with the web on it over the second dryer group;

a transfer region between the first and the second dryer groups at which the web is transferred from the first support belt to the second support belt;

one guide roll generally at the transfer region in normal engagement with at least one of the first and second support belts, the one guide roll being displaceable between a web support position, at which the one guide roll is positioned to guide the at least one support belt at the one guide roll to where the at least one support belt supports the web in its travel through the transfer region, the web being transferred continuously, without any unsupported length, from the first support belt to the second support belt, and a web free length position away from the web support position, at which the one guide roll guides the at least one support belt to not support the web over part of the path of the web through the transfer region, defining a free length of the web in the transfer region;

a web tip cutter positioned to cut the free length of the web in the web transfer region when the one guide roll is in its web free length position, for producing a starting end of the web to be threaded.

12. The dry end of claim 11, wherein the first dryer group includes a last one of the first dryer cylinders and the second dryer group includes a first one of the second dryer cylinders in the path of the web through the dry end, the transfer region being between the last of the first dryer cylinders and the first of the second dryer cylinders; there is at least one web support belt deflection roll between the last of the first dryer cylinders and the first of the second dryer cylinders; at least one of the first and second support belts, with the web supported on it, passing around the one deflection roll, the moveable guide roll being placed such that the free length of web is formed between the deflection roll and one of the first and the second dryer groups.

* * * * *